US005606838A

United States Patent [19]

Hughes et al.

[11] Patent Number: 5,606,838

[45] Date of Patent: Mar. 4, 1997

[54] ROOF PANEL ATTACHMENT CLIP WITH CENTERING FEATURE

[75] Inventors: Robert W. Hughes, Kirkcaldy; Bryan Balshaw, Kinghorn, both of Scotland

[73] Assignee: Butler Manufacturing Company, Kansas City, Mo.

[21] Appl. No.: 448,260

[22] Filed: May 23, 1995

[51] Int. Cl.[6] ..... E04D 1/34

[52] U.S. Cl. ..... 52/713; 52/520; 52/545; 52/547

[58] Field of Search ..... 52/544, 545, 547, 52/549, 550, 551, 747.1, 748.1, 588.1, 713, 714, 91.3, 520, 528, 529, 530, 531, 537, 538

[56] References Cited

U.S. PATENT DOCUMENTS

| | | | |
|---|---|---|---|
| 3,998,019 | 12/1976 | Reinwall, Jr. . | |
| 4,177,615 | 12/1979 | Anderson | 52/528 |
| 4,193,247 | 3/1980 | Heckelsberg . | |
| 4,296,581 | 10/1981 | Heckelsberg . | |
| 4,348,846 | 9/1982 | Bellem | 52/528 |
| 4,361,998 | 12/1982 | Ellison et al. . | |
| 4,366,656 | 1/1983 | Simpson | 52/528 |
| 4,435,937 | 3/1984 | Stone | 52/520 |
| 4,522,005 | 6/1985 | Seaburg et al. | 52/713 |
| 4,543,760 | 10/1985 | Barker et al. . | |
| 4,557,098 | 12/1985 | Thurnau et al. . | |
| 4,796,403 | 1/1989 | Fulton et al. . | |
| 5,001,882 | 3/1991 | Watkins et al. . | |
| 5,181,360 | 1/1993 | Shingler | 52/547 |
| 5,222,341 | 6/1993 | Watkins et al. . | |

*Primary Examiner*—Michael Safavi
*Attorney, Agent, or Firm*—Shoemaker and Mattare, Ltd.

[57] ABSTRACT

A roof panel attachment clip includes a bracket having an upper flange, and a sliding member which supports one or more tabs. The sliding member and the bracket have alignable openings such as slots above a hole for receiving a bolt which connects the bracket to a purlin. The openings are sized to receive the shaft of an installation tool, such as a socket wrench, and must be aligned in order to get the wrench properly on the fastener. The installer is thus assisted in centering the tabs in the slots as he connects the bracket to the purlin. Once the tool is withdrawn, it is possible to slide the tabs out of position, but a biasing force between the sliding member and the bracket resists such movement.

6 Claims, 4 Drawing Sheets

ROOF PANEL ATTACHMENT CLIP WITH CENTERING FEATURE

BACKGROUND OF THE INVENTION

This invention relates generally to building construction and more particularly to a roof panel attachment clip for metal roofs on large buildings.

Butler Manufacturing Company, and other manufacturers, specialize in the construction of large metal buildings such as warehouses. The roof on such a building typically comprises a substructure or frame formed from structural beams and metal purlins running between the gables. The purlins and beams support an array of metal panels which are overlapped in the direction perpendicular to the roof ridge. A common way of joining the panels laterally is to preform vertical edge flanges on them, and then roll the mating flanges of adjacent panels together to form a so-called standing seam roof. The connection between the purlins and the metal flanges may be a short vertical strap whose upper end is rolled into the flange. The lower end of the strap may be slidably attached to the clip, which is in turn affixed to the purlin by rivets, bolts or screws.

For all-metal roofs, provision has to be made for thermal expansion and contraction. The substructure temperature remains much more stable than the roof panels, which may undergo large temperature swings as a result of solar heating and changes in ambient air temperature. In a large roof, the cumulative differential expansion may be several inches. Use of high-expansion materials like aluminum aggravates the problem.

In the lateral direction, parallel to the roof ridge, the standing seams act as small expansion loops which accommodate changes in panel width resulting from temperature changes. But as there are no corresponding corrugations in the ridge-wise direction, some provision has to be made in the panel mounting structure. A number of prior patents disclose devices in which the mounting tab, or similar structure, rides in a slot in a bracket as the roof temperature changes.

When installing roofs with slotted brackets, installers are directed to center the tabs in the slots initially. But, should the installer fail to do so, and place the tab at one end of the slot, the tab will not be able to move in one direction. Then, undesirable stress will be placed on the bracket when extreme roof expansion or contraction, as the case may be, occurs. Admonitions may be insufficient to insure uniformly correct installation.

SUMMARY OF THE INVENTION

An object of the invention is to insure that standing seam roof mounting tabs are mounted in a sliding bracket at the center of their travel during roof installation.

These and other objects are attained by providing a standing seam roof attachment clip, having a slotted tab receiving flange, with a sliding member which supports one or more tabs. The sliding member and the bracket have alignable openings such as slots above a hole for receiving the fastener which connects the bracket to a purlin. The slots are sized to receive the shaft of an installation tool, such as an impact socket wrench or electric screw gun, and must be aligned in order to get the socket properly on the fastener. The installer is thus assisted in centering the tabs in the slots as he connects the bracket to the purlin. Once the tool is withdrawn, it is possible to slide the tabs out of position, but a biasing force between the sliding member and/or the tabs on the one hand, and the bracket on the other, resists inadvertent misalignment during panel installation.

BRIEF DESCRIPTION OF THE DRAWINGS

In the accompanying drawings.

DESCRIPTION OF THE PREFERRED EMBODIMENT

Figure 2:
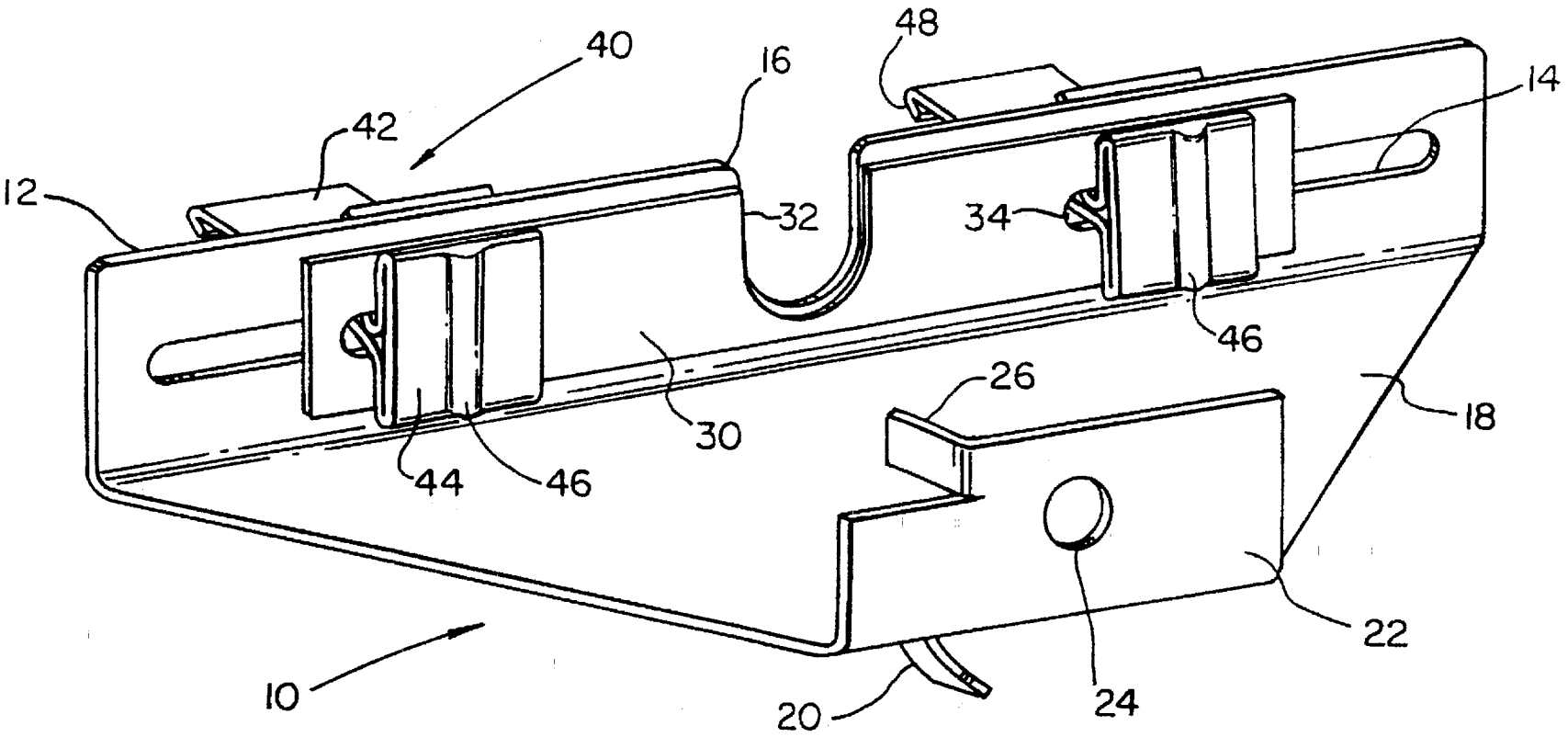
FIG. 2 is a detailed perspective view, from below, of a mounting bracket embodying the invention.
Figure 4:
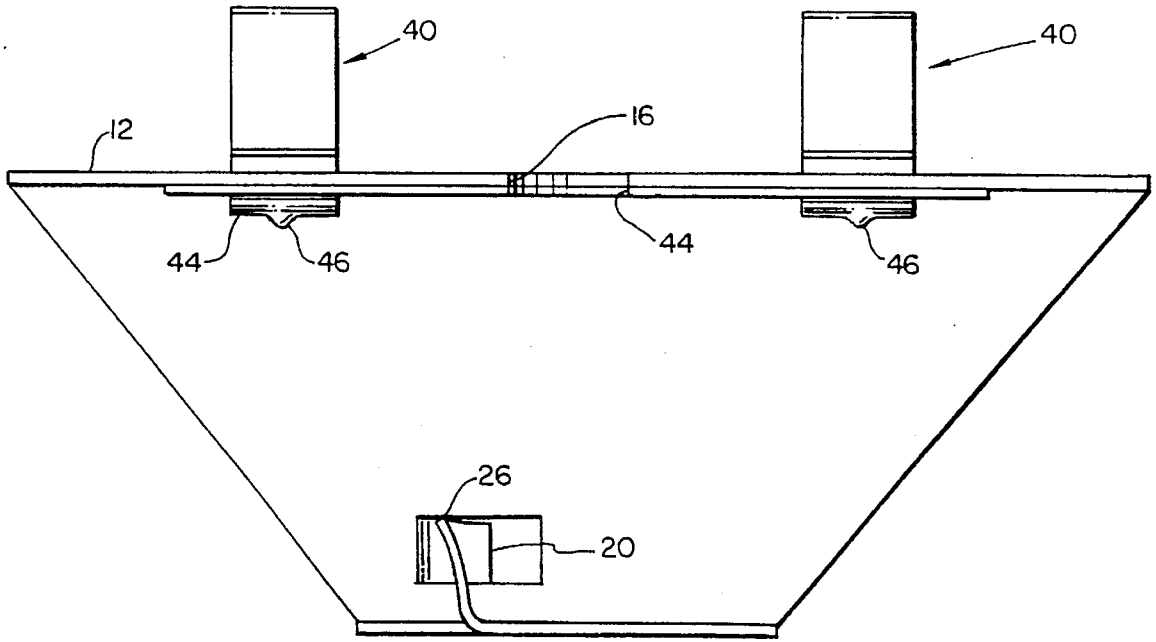
FIG. 4 is a side view of the bracket.
Figure 3:
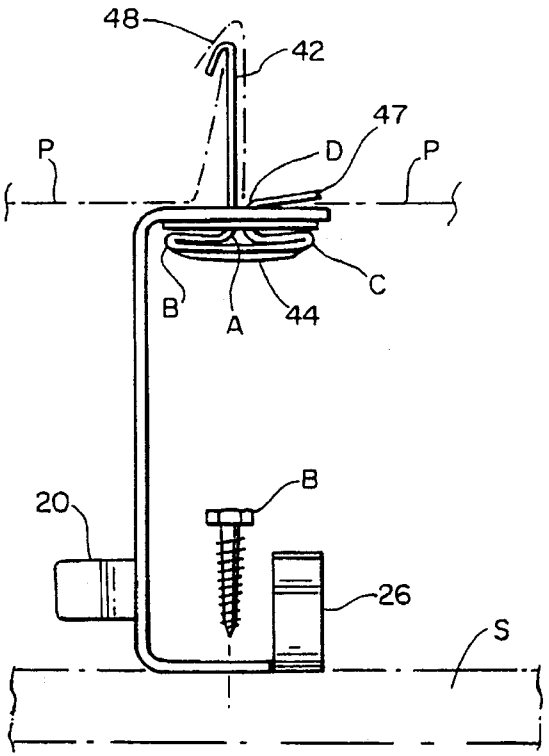
FIG. 3 is an end view of the bracket.
Figure 5:
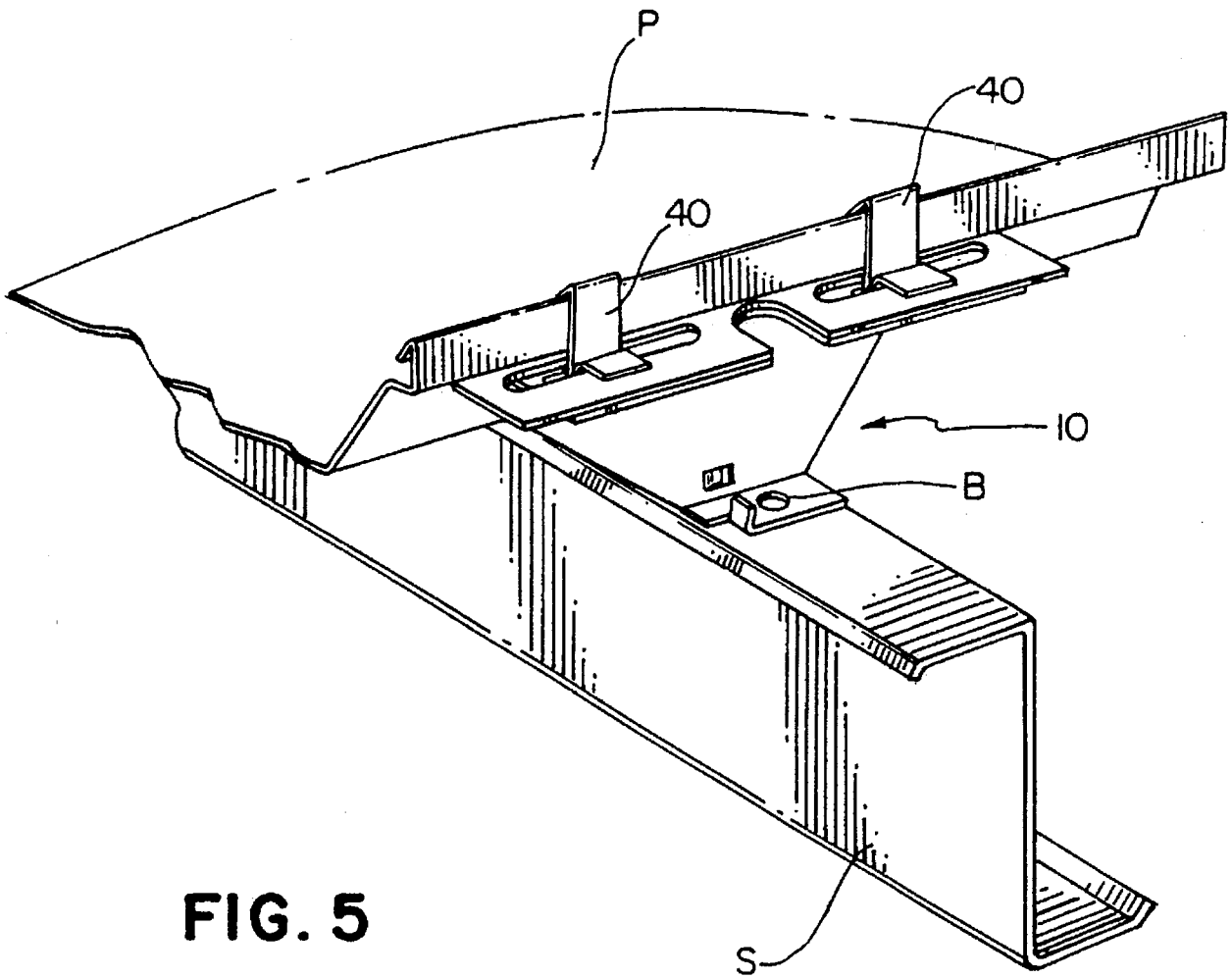
FIG. 5 is an isometric view of the attachment clip, mounted on a purlin and associated with one roof panel.

A roof panel mounting bracket embodying the invention includes a "C" channel body member 10 illustrated in FIGS. 2–4. The member illustrated is trapezoidal, when viewed from the side, but the shape is not critical to the invention.

The upper flange 12 of the body member has a pair of longitudinal slots 14, and a "U"-shaped central recess 16, open along the free edge of the flange. The web 18 of the body is unremarkable, except for a laterally extending tab 20 whose purpose is unrelated to this invention. The bottom flange 22 has a central hole 24, aligned with the center of the recess above, and a tab 26 extending vertically upward to one side of the hole.

The sliding member 30, best seen in FIG. 2, is a light-gauge rectangular piece having a lateral recess 32 like that formed in the body member, and a pair of slots 34 for receiving the tabs. Unlike their counterparts in the body member, these slots are barely wide enough to receive the mounting tabs 40 described below. When the recesses 16 and 32 are aligned, each slot 34 is centered beneath a corresponding slot 14 so that the each tab is centered in its slot 14.

The tabs, two being used in the preferred embodiment, each have an upper end 42 which is initially hung over a roof panel flange ("P", FIG. 3) and ultimately rolled with it when forming the seam between adjacent panels. The lower end is bent at four locations A,B,C,D to form a double-thickness "T" head 44, as described below.

The tab is formed from a flat strip of steel. A short longitudinal ridge 46 is formed about midway between the ends to facilitate manipulation of the head and to reinforce it. The T-head 44 is formed by folding the strip down 180° at locations A and B at either end of the longitudinal ridge, and up 90° at locations C and D. The free, unbent ends are together inserted through the slots in both the sliding member and bracket body; the short end 47 is then bent over horizontal to retain the tab, and capture the sliding member between the "T" head and the bottom of the upper flange. A short hook 48 is formed at the tip of the longer end, so that the device can be temporarily suspended (FIG. 3) from one roof panel flange during installation, before the seam is formed, capturing the tip.

The function of the tab is two-fold: to prevent lateral movement of the roof panels, and to prevent the panels from lifting in windy conditions. The weight of the roof panels and precipitation on them is borne directly by the bracket body, as the roof panel rests upon the upper flange.

The outward bending of the short end 47 of the strip not only retains the tab in the slot, but also compresses the sliding member slightly against the body flange. As a result, there is some frictional resistance to moving of the slider, so the slider tends to stay put, unless it is deliberately moved by the installer.

Figure 1:
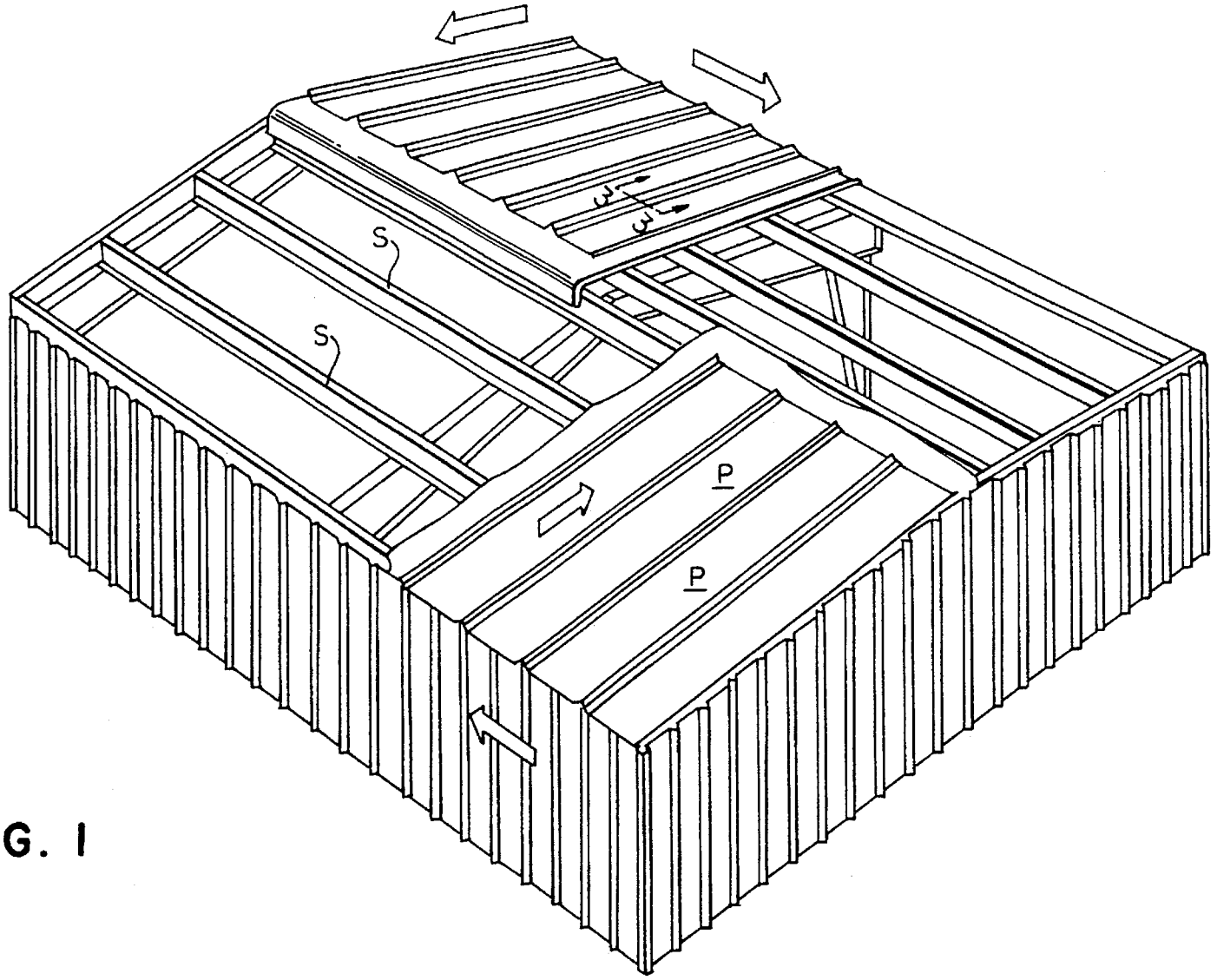
FIG. 1 is a perspective view of a standing seam roof, with portions cut away to show the underlying substructure and mounting brackets.

During installation on a building (shown in FIG. 1), the sliding member is moved, if necessary, to align its opening with that of the bracket body, consequently centering the tabs in the slots. The hooks 48 of the tabs are placed over the upstanding lateral flange of a previously installed panel "P", and the bracket is secured to an underlying purlin "S" by driving a fastener, such as a self-drilling and tapping bolt "B" (FIG. 3), through the hole 24 in the lower flange 22. After the brackets have been installed along a ridge-wise line, a fresh row of panels, shown by a broken line P in FIG. 3, are installed by hooking their lateral flanges over those of the previous row, and mechanically rolling the flanges together to form a double lock seam. The securing tab ends are now permanently secured within the seam. Panel installation progresses in the directions indicated by the arrows in FIG. 1.

Since the invention is subject to modifications and variations, it is intended that the foregoing description and the accompanying drawings shall be interpreted as illustrative of only one form of the invention, whose scope is to be measured by the following claims.

We claim:

1. A roof panel attachment clip comprising a body comprising a channel member having an upper flange for supporting a roof panel and a lower flange for attachment to a substructural roof member by means of a fastener applied with a tool, said upper flange having a longitudinal slot therein, a sliding member facing one surface of the upper flange, said sliding member having a slot aligned with the slot in the upper flange, a roof panel securing tab having an enlarged head below said slots, and a first free end extending upward through said slots and adapted to be rolled into a seam formed between adjacent roof panels, both said upper flange and said sliding member having similarly shaped openings which must be aligned about the tool axis in order to drive the fastener, and which, when aligned, center the tab within the slot in the upper flange through which the tab passes.

2. The invention of claim 1, wherein said tab further comprises a second free end extending upward through said slots then bent outward to retain the tab in the slots and draw the head upward, creating a biasing force between the upper flange and the sliding member, whereby the sliding member tends to remain in a set position.

3. The invention of claim 2, wherein the sliding member is disposed below the flange, facing the flange's bottom surface.

4. The invention of claim 1, wherein the first free end terminates at a tip bent to form a hook for engaging over an upstanding lateral flange of a roof panel.

5. The invention of claim 1, wherein said enlarged head comprises a double-thickness T-head formed by folding the tab upon itself.

6. The invention of claim 5, wherein the T-head has a reinforcing ridge running perpendicular to the length of the slot, to prevent the head from being pulled through the slot by large wind uplift forces.

* * * * *